US010954906B2

(12) United States Patent
Kromer et al.

(10) Patent No.: US 10,954,906 B2
(45) Date of Patent: Mar. 23, 2021

(54) FUEL INJECTOR HAVING AN IMPROVED HIGH-PRESSURE CONNECTION

(75) Inventors: Ralf Kromer, Vaihingen an der Enz (DE); Guenter Wolff, Schwieberdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 284 days.

(21) Appl. No.: 13/978,828

(22) PCT Filed: Jan. 17, 2012

(86) PCT No.: PCT/EP2012/050591
§ 371 (c)(1),
(2), (4) Date: Sep. 5, 2013

(87) PCT Pub. No.: WO2012/098087
PCT Pub. Date: Jul. 26, 2012

(65) Prior Publication Data

US 2013/0333669 A1 Dec. 19, 2013

(30) Foreign Application Priority Data

Jan. 21, 2011 (DE) ..... 10 2011 002 996.6

(51) Int. Cl.
*F02M 55/00* (2006.01)
*F02M 55/02* (2006.01)
*F02M 61/14* (2006.01)

(52) U.S. Cl.
CPC ..... *F02M 55/004* (2013.01); *F02M 55/005* (2013.01); *F02M 55/025* (2013.01); *F02M 61/14* (2013.01)

(58) Field of Classification Search
CPC .. F02M 69/465; F02M 55/025; F02M 55/004; F02M 55/005; F02M 55/04; F02M 61/14; F02M 55/02
(Continued)

(56) References Cited

U.S. PATENT DOCUMENTS 4,766,697 A * 8/1988 Boileau ..... B60J 1/17 49/348
5,226,391 A * 7/1993 Gras ..... F02M 51/005 123/456
(Continued)

FOREIGN PATENT DOCUMENTS

CN 1462340 A 12/2003
CN 101421507 A 4/2009
(Continued)

*Primary Examiner* — Lindsay M Low
*Assistant Examiner* — Omar Morales
(74) *Attorney, Agent, or Firm* — Norton Rose Fulbright US LLP; Gerard Messina

(57) ABSTRACT

A fuel injection device includes a rail having at least one outflow opening, at least one injector situated on the rail, a connecting piece situated on the injector, and a flange element for fastening the injector on the rail. The flange element includes a central opening through which the connecting piece is guided. A metal-metal sealing is provided between the connecting piece and the rail. The connecting piece is designed in one piece with an undercut, and the flange element engages with the undercut of the connecting piece. The connecting piece presses against the rail in a sealing manner.

30 Claims, 6 Drawing Sheets

(58) Field of Classification Search
USPC ..... 123/456, 495, 469, 516, 470; 73/756
See application file for complete search history.

(56) References Cited

U.S. PATENT DOCUMENTS

| | | | | |
|---|---|---|---|---|
| 5,261,705 | A * | 11/1993 | Takahashi | F02M 55/005 285/114 |
| 5,667,255 | A * | 9/1997 | Kato | F02M 55/005 285/133.4 |
| 2003/0145833 | A1 | 8/2003 | Wagner et al. | |
| 2007/0006848 | A1* | 1/2007 | Ricco | F02M 55/005 123/456 |
| 2009/0107462 | A1 | 4/2009 | Gibson et al. | |
| 2009/0126694 | A1* | 5/2009 | Ritz | F02M 37/0011 123/495 |
| 2010/0071664 | A1* | 3/2010 | Hunt | F02M 55/025 123/456 |

FOREIGN PATENT DOCUMENTS

| | | | |
|---|---|---|---|
| CN | 101842576 | A | 9/2010 |
| DE | 102004049804 | | 4/2006 |
| DE | 102006017900 | | 10/2007 |
| DE | 102009020867 | A1 | 11/2010 |
| EP | 0508362 | A2 | 10/1992 |
| EP | 1310669 | A2 | 5/2003 |
| FR | 2878604 | | 6/2006 |
| JP | H04-171267 | | 6/1992 |
| JP | H07-259691 | | 10/1995 |
| JP | H08-254167 | | 10/1996 |
| JP | H09-14097 | | 1/1997 |
| JP | H09-144618 | | 6/1997 |
| JP | H09-242643 | | 9/1997 |
| JP | H09-291866 | | 11/1997 |
| JP | H10-299610 | | 11/1998 |
| JP | 2000-512361 | | 9/2000 |
| JP | 2000-515610 | | 11/2000 |
| JP | 2001-304075 | | 10/2001 |
| JP | 2003-148297 | | 5/2003 |
| JP | 2003-227437 | | 8/2003 |
| JP | 2003-343785 | | 12/2003 |
| JP | 2004-019541 | | 1/2004 |
| JP | 2005-507052 | | 3/2005 |
| JP | 2005-155451 | | 6/2005 |
| JP | 2006-037866 | | 2/2006 |
| JP | 2006-070800 | | 3/2006 |
| JP | 2006220084 | | 8/2006 |
| JP | 2006-275210 | | 10/2006 |
| JP | 2007-016775 | | 1/2007 |
| JP | 2008-133817 | | 6/2008 |
| JP | 2009-533591 | | 9/2009 |
| JP | 2010-180875 | | 8/2010 |

* cited by examiner

FUEL INJECTOR HAVING AN IMPROVED HIGH-PRESSURE CONNECTION

FIELD OF THE INVENTION

The present invention relates to a fuel injector having an improved high-pressure connection between an injector and a rail.

BACKGROUND INFORMATION

Fuel injectors are known from the related art in various embodiments. In high-pressure injection systems, a metal-metal connection instead of an o-ring sealing is increasingly used between a rail (fuel storage device) and an injector in order to reduce HC emission. These metal-metal connections, however, require relatively strong forces, using which the surfaces must be pressed onto one another, to ensure a sufficient tightness. Oftentimes, the force necessary thereto is applied to the metal sealing surfaces with the aid of a cap nut which is fastened by screws. In the known approach, a plurality of individual components is, however, necessary, in particular multiple ring segments being used for force transmission. On the one hand, this results in high manufacturing costs due to the plurality of components and, on the other hand, in an increased mounting complexity. It would therefore be desirable to have a reliable connection which may be easily mounted between an injector and a rail even for high-pressure applications.

SUMMARY

The fuel injection device according to the present invention has the advantage over the related art that a metal-metal sealing is possible which does not allow leakages in a rail even at high pressures. According to the present invention, an angular misalignment potentially present between the rail and an injector may furthermore be compensated for by a connecting piece according to the present invention. According to the present invention, a flange element is furthermore provided to fasten the injector on the rail, the flange element engaging with an undercut on the one-piece connecting piece and pressing the connecting piece against the rail to enable a reliable metal-metal sealing. In this case, it is possible to reduce the number of parts and furthermore to simplify a mounting.

The metal-metal sealing is preferably a metallic ball-cone sealing, the spherical area preferably being provided on the connecting piece and the cone on the rail.

Furthermore preferably, the flange element has a two-part design having a first and a second part. In this way, a particularly simple mounting of the flange area on the connecting piece may be made possible.

Particularly preferably, the first part of the flange element is constructed identically to the second part of the flange element. This results in a particularly cost-effective manufacturability. Furthermore, the risk of mixing up the parts during mounting is eliminated.

The two-part flange element is preferably divided at a central opening through which the connecting piece is guided. This makes a lateral mounting of the flange element on the connecting piece possible.

According to one alternative preferred embodiment of the present invention, the flange element is designed in one piece. This allows for an even easier mounting of the flange element.

Particularly preferably, the one-piece flange element includes a mounting opening which is connected to the central opening via a continuous connecting slot. This makes it possible for the connecting piece to be guided at least partially through the mounting opening of the flange element and subsequently to be situated in the central opening via the continuous connecting slot. This may take place by tilting the flange element, for example. Particularly preferably, the mounting opening is situated at an angle of approximately 45° to the central opening.

According to another alternative embodiment of the present invention, the flange element is designed in one piece, and a connection in the form of a bayonet joint is provided between the flange element and the connecting piece. In this way, a simple mounting, e.g., by inserting and subsequently rotating the flange element, may take place.

Particularly preferably, the undercut has a partially spherical shape on the connecting piece, and one or multiple partially spherical areas having the same or a very similar radius to the radius on the undercut are formed on the flange element. In this way, a very good angle compensation between rail and injector may be made possible in a particularly simple manner.

Furthermore preferably, a chamfer is provided on a central opening of the flange element which is directed toward the connecting piece. In this way, a contact area between the flange element and the connecting piece is enlarged.

The present invention is preferably used in high-pressure injection systems.

DETAILED DESCRIPTION

Figure 1:
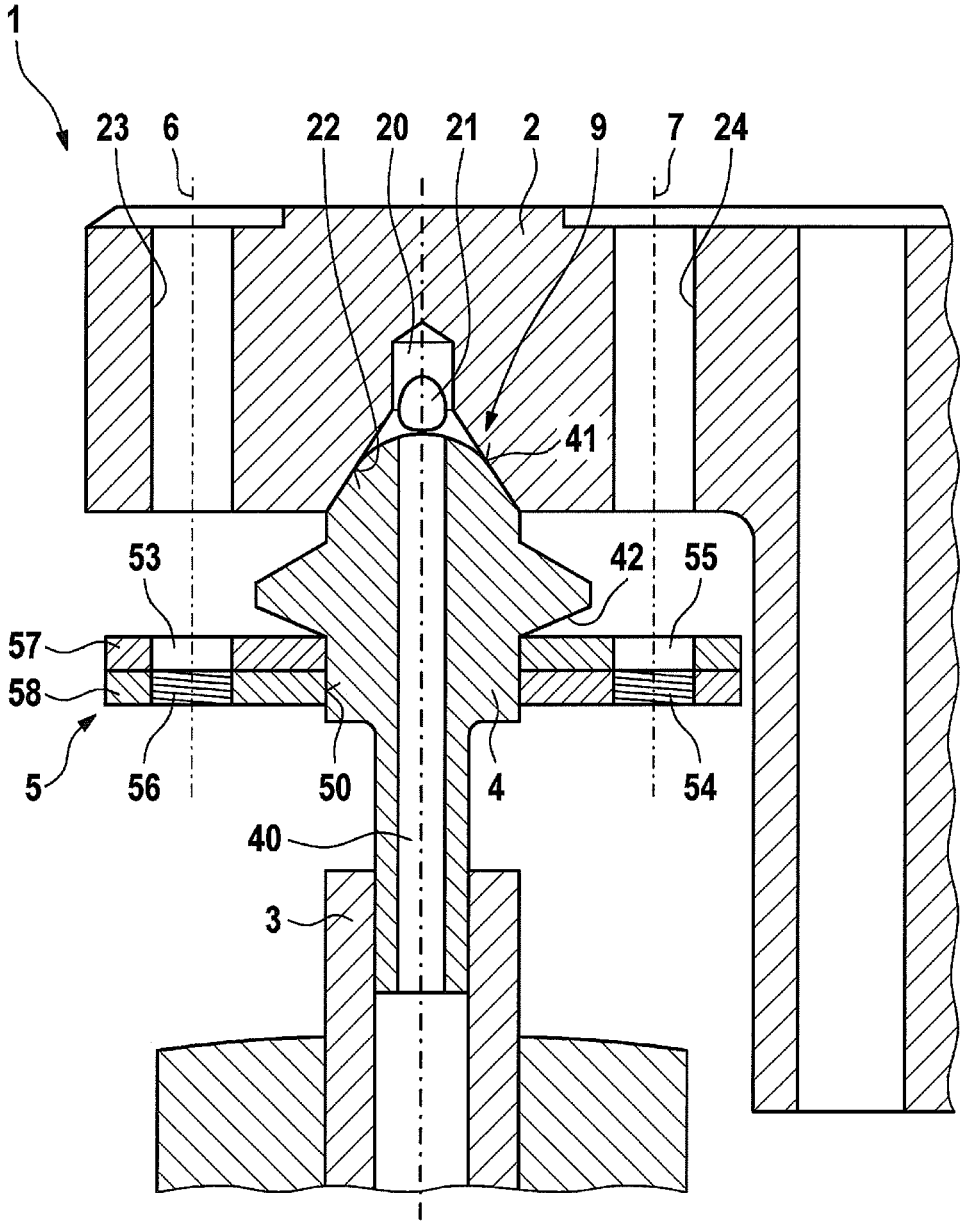
FIG. 1 shows a schematic sectional view of a fuel injection device according to one first exemplary embodiment of the present invention.

A fuel injection device 1 according to one first preferred exemplary embodiment of the present invention is described in detail below with reference to FIGS. 1 through 4. As is apparent from FIG. 1, fuel injection device 1 includes a rail 2 having a central storage bore 20 from which a plurality of outflow openings 21 originates, only one outflow opening 21 to the injector being illustrated in FIG. 1 for the sake of clarity. Furthermore, fuel injection device 1 includes an injector 3 on which a connecting piece 4 having a central pass-through bore 40 is situated. Connecting piece 4 represents a connection between the rail and injector 3. Connecting piece 4 has a spherical area 41 on the end directed toward rail 2 as well as an undercut 42. A conic area 22 is formed on rail 2 on outflow opening 21.

Figure 2:
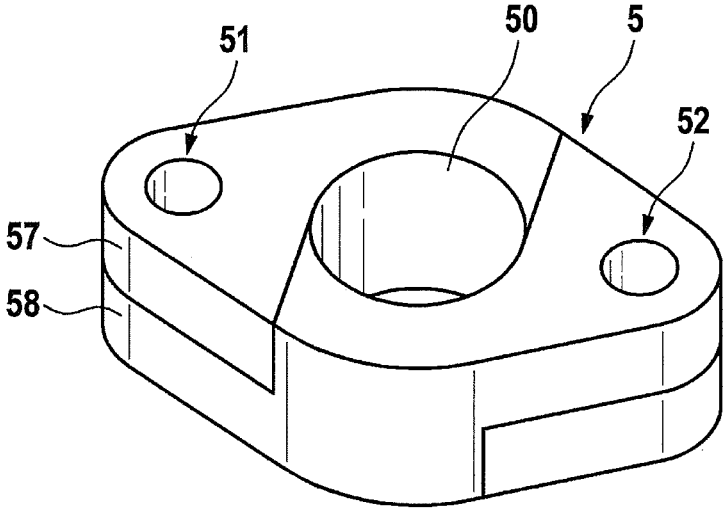
FIG. 2 shows a schematic, perspective view of a flange element from FIG. 1 in the assembled state.
Figure 3:
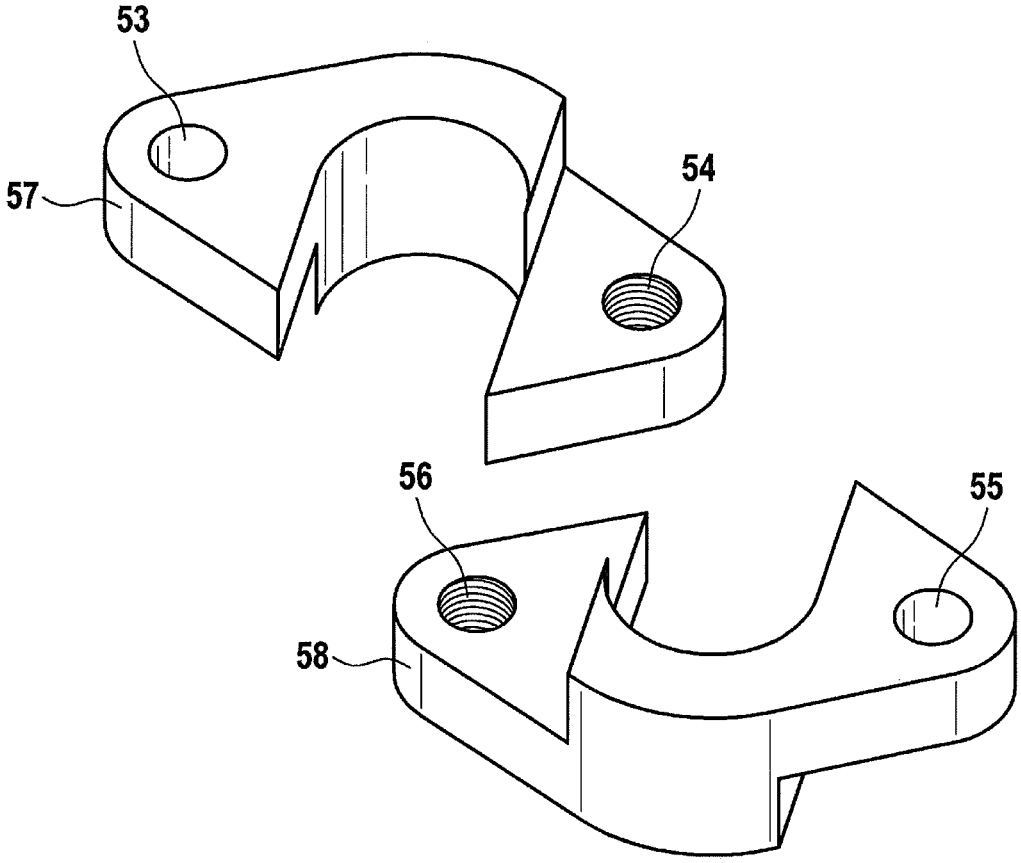
FIG. 3 shows a schematic, perspective view of the individual parts of the flange element.
Figure 4:
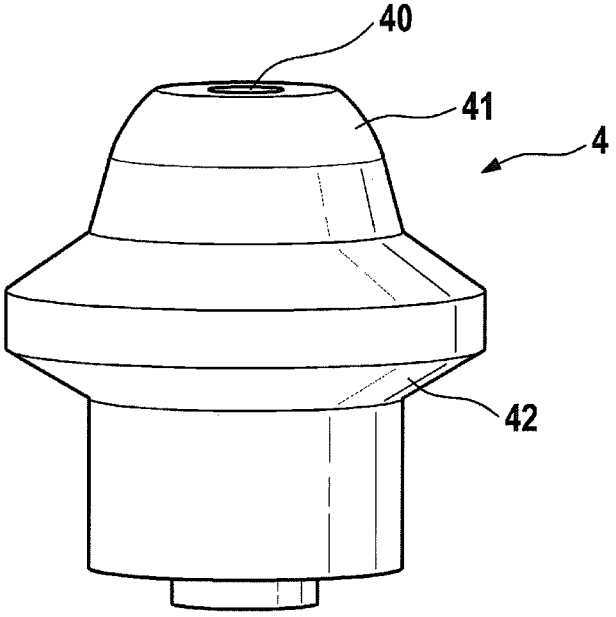
FIG. 4 shows a schematic, perspective view of the connecting piece between the rail and the injector.

Furthermore, fuel injection device 1 according to the present invention includes a flange element 5 which is shown in detail in FIGS. 2 and 3. Flange element 5 has a two-part design and includes a first flange part 57 and a second flange part 58. Both flange parts 57, 58 are in this case identical and are pushed against one another to form flange element 5. On flange element 5, a first fastening opening 51 and a second fastening opening 52 are provided, each of which are formed by partial openings in first and second flange parts 57, 58. As shown in FIG. 3, in particular, a first partial opening 53 without a thread and a second partial opening 54 with a thread are provided on first flange part 57. Similarly, second flange part 58 having a first partial opening 55 without a thread and a second partial opening 56 with a thread is provided. In the assembled state of the flange element, a partial area of fastening openings 51, 52 is thus provided with a thread in each case.

As is apparent from FIG. 1, schematically indicated fastening elements 6, 7 in the form of screws, which are stuck through pass-through bores 23, 24 provided in rail 2 and are screwed into flange element 5, are also used for mounting flange element 5. This results in an axial preload force acting on connecting piece 4. For this reason, spherical area 41 is pressed against conic area 42, whereby a metal-metal sealing 9 is established between rail 2 and connecting piece 4. This necessary contact force is applied to connecting piece 4 via fastening elements 6, 7, flange element 5, and undercut 42.

In this way, a reliable metal-metal sealing 9 may be made possible between rail 2 and injector 3 with the aid of a two-part flange element 5. With the aid of the two-part embodiment of flange element 5, flange element 5 may be easily attached to connecting piece 4 from the side below undercut 42, so that connecting piece 4 runs through central opening 50 in flange element 5. By screwing in the two fastening elements 6, 7, flange element 5 is then tightened in the direction of rail 2 and thus applies the preload force necessary for the sealing to connecting piece 4.

Thus, according to the present invention, the injector, including a final extrusion coating using a plug (not shown), may be finished, and it is not until the final assembly that two-part flange element 5 is assembled on the injector, more specifically on connecting piece 4 which is fixedly fastened to injector 3. In addition to reducing the number of parts, flange element 5 may also be attached very quickly and easily. Another advantage is that a risk of damaging spherical area 41 and conic area 42 is considerably reduced due to the mounting below undercut 42. This is a significant advantage over the related art, since the mounting may take place laterally and even the least amount of damage in the spherical area or in the conic area may result in leakages due to the extremely high pressures of above 20 MPa.

It should be noted that on the side of central opening 50 directed toward rail 2 a chamfer (not shown) for a larger contact surface may be provided between connecting piece 4 and flange element 5.

Figure 5:
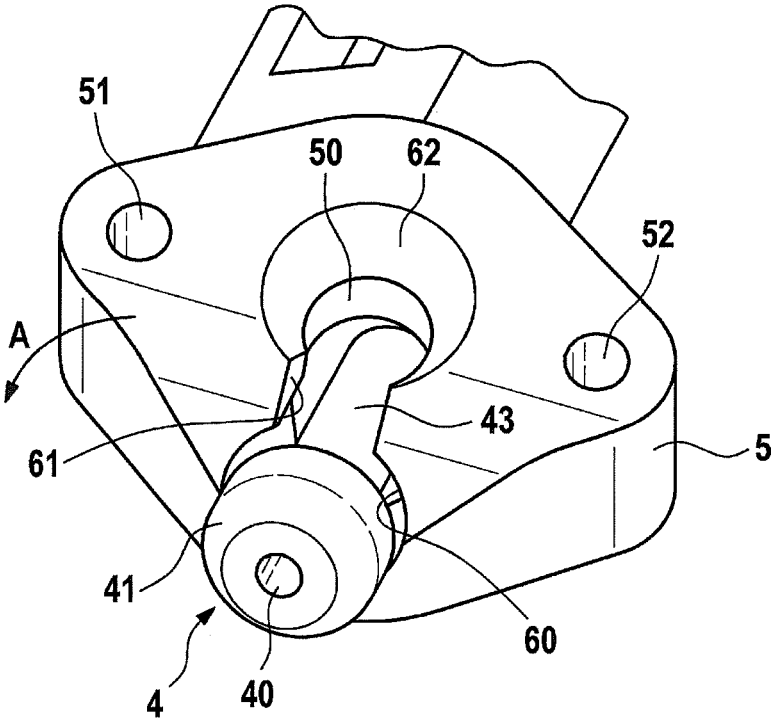
FIG. 5 shows a schematic, perspective view of a fuel injection device having a flange element according to one second exemplary embodiment of the present invention.
Figure 6:
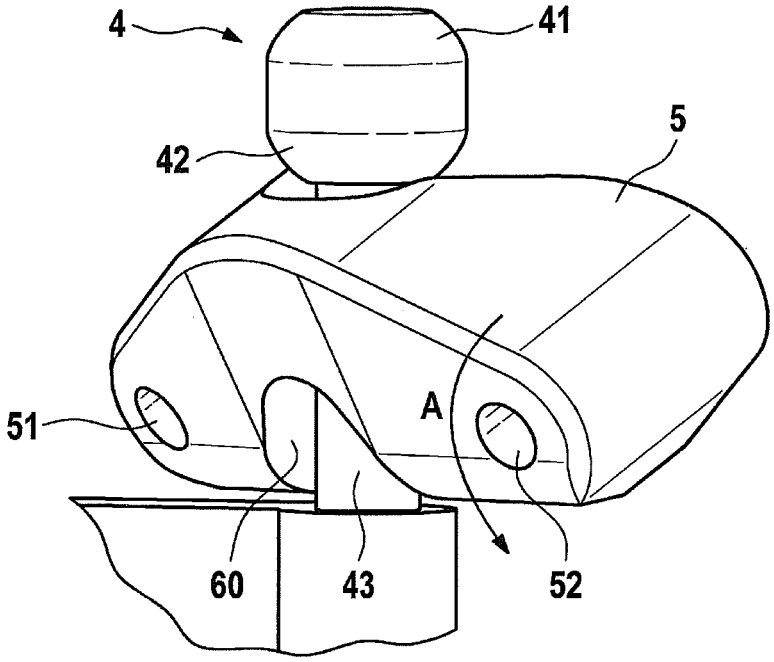
FIG. 6 shows a schematic, perspective view of the flange element from FIG. 5 from a different perspective.
Figure 7:
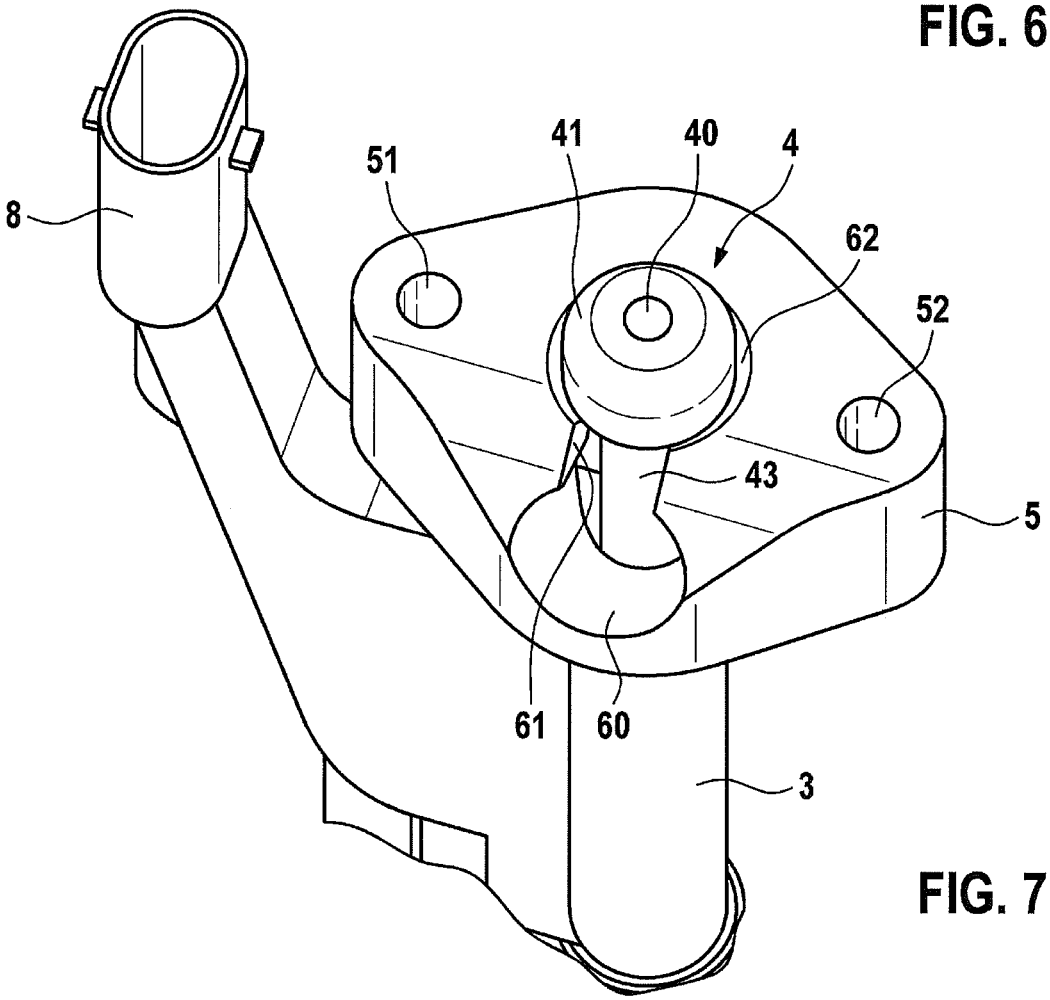
FIG. 7 shows a schematic, perspective view of the flange element from FIG. 5 in the mounted state.

FIGS. 5 through 7 show a fuel injection device according to one second exemplary embodiment of the present invention, identical or functionally identical parts being identified by the same reference numerals as in the first exemplary embodiment. In contrast to the first exemplary embodiment, flange element 5 is designed in one piece in the second exemplary embodiment. Furthermore, flange element 5 of the second exemplary embodiment has, in addition to central opening 50, a mounting opening 60 which is also formed as a continuous opening through flange element 5. Mounting opening 60 is connected to central opening 50 via a connecting slot 61 which is also designed to be continuous. An axis of mounting opening 60 is in this case situated at an angle of approximately 45° in relation to the axis of central opening 50. This makes it possible for flange element 5 to be pushed in a first step via mounting opening 60 over connecting piece 4 protruding from injector 3, as shown in FIGS. 5 and 6. Here, connecting piece 4 has a relatively long neck section 43. Flange element 5 is then pivoted out of the positions shown in FIGS. 5 and 6 in the direction of arrow A by approximately 45°, so that connecting piece 4 is then situated in central opening 50, as shown in FIG. 7. Subsequently, for the mounting of injector 3 on rail 2, as in the first exemplary embodiment, flange element 5 is fixed on rail 2 via first and second fastening openings 51, 52 with the aid of fastening elements not shown, a relatively wide, conic chamfer 62 pressing against an undercut 42, which is also cone-shaped, and thus pressing spherical area 41 again against conic area 22 of rail 2 (not shown). A plug is furthermore identified with reference numeral 8 in FIG. 7.

It should be pointed out that tilting back of flange element 5 or unintentional twisting of flange element 5 may be prevented by a plastic clip, for example.

Thus, the second exemplary embodiment has a one-piece flange element 5 having a central opening 50 and a separate mounting opening 60 which is situated at an angle to central opening 50. Flange element 5 may be put into a mounting position for being mounted on rail 2 with the aid of a simple pivoting process.

Figure 8:
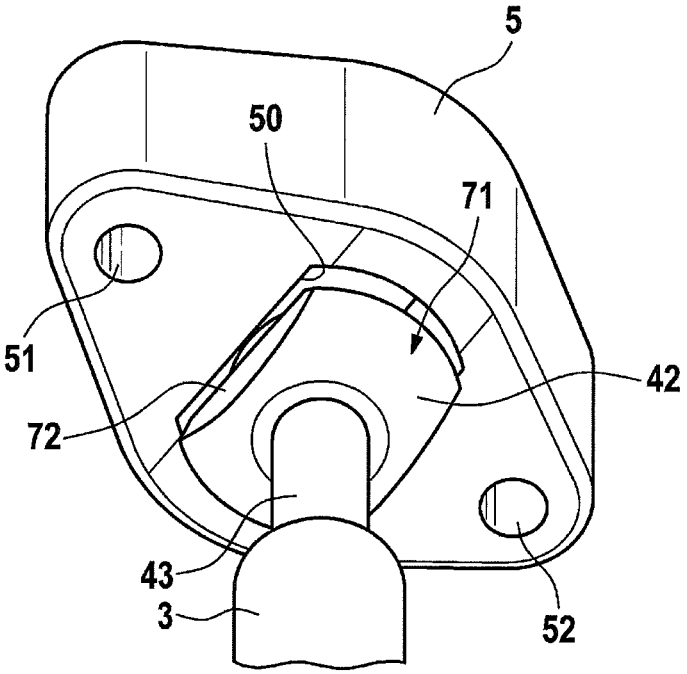
FIG. 8 shows a schematic, perspective view of a fuel injection device having a flange element according to one third exemplary embodiment of the present invention.
Figure 9:
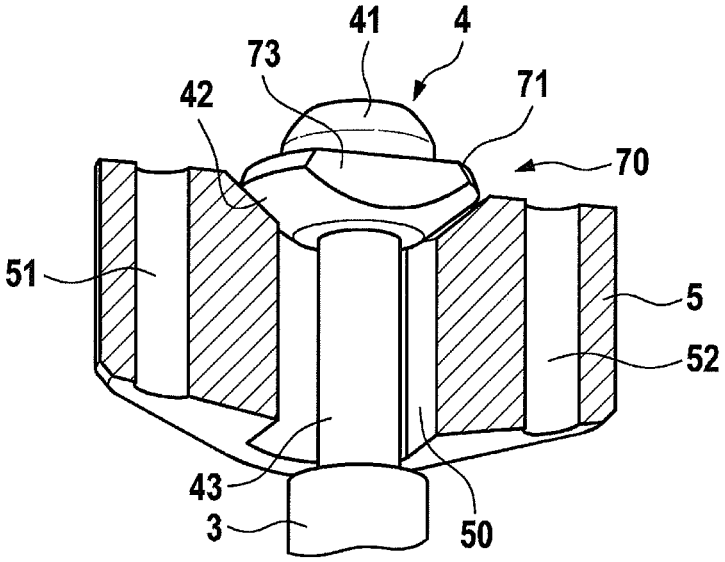
FIG. 9 shows a schematic sectional view of the flange element from FIG. 8.
Figure 10:
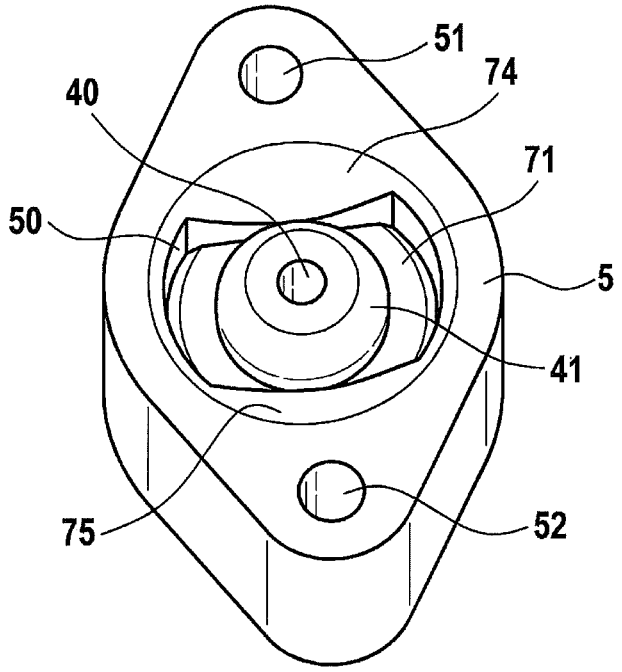
FIG. 10 shows a schematic, perspective view of the mounting process of the flange element from FIG. 8.
Figure 11:
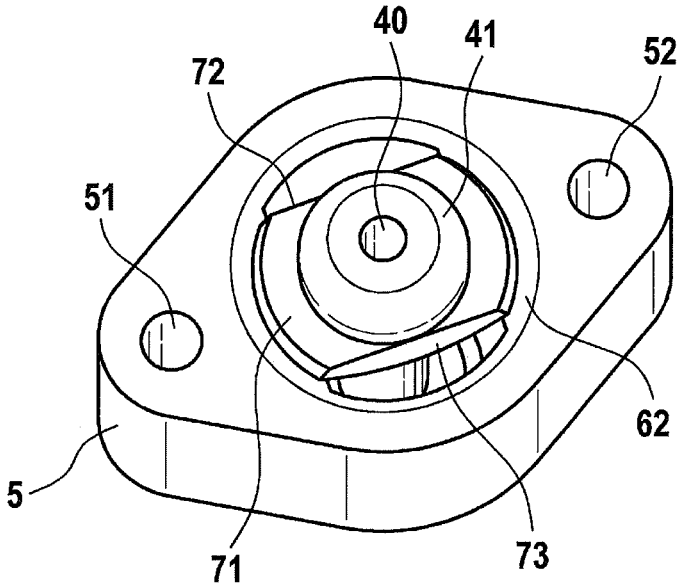
FIG. 11 shows a schematic, perspective view of the mounted flange element from FIG. 10.

In FIGS. 8 through 11, a fuel injection device according to one third exemplary embodiment of the present invention is described in detail, identical or functionally identical parts being, in turn, identified by the same reference numerals as in the first exemplary embodiment. In contrast to the second exemplary embodiment, a connection 70 in the form of a bayonet joint is provided between connecting piece 4 and flange element 5 in the fuel injection device of the third exemplary embodiment. For this purpose, a bayonet element 71 having a first flattened side 72 and a second flattened side 73 is provided on connecting piece 4. Undercut 42, which has a spherical shape in the third exemplary embodiment, is furthermore provided on bayonet element 71. As is apparent from FIG. 8, in particular, central opening 50 of flange element 5 is formed having a contour which matches bayonet element 71, so that bayonet element 71 may only be inserted into central opening 50 in an aligned direction. FIG. 8 shows here the insertion procedure from below and FIG. 10 shows the insertion procedure from above, connecting piece 4 almost being guided completely through flange element 5 in FIG. 10. If flange element 5 may be rotated in relation to connecting piece 4 in the position shown in FIGS. 9 and 11, flange element is rotated by 90°, so that undercut 42 makes contact with a first and a second contact area 74, 75. Then, as shown in the previous exemplary embodiments, two fastening elements 6, 7 are screwed into fastening openings 51, 52, which are both equipped with a thread, so that flange element 5 is pressed against undercut 42, and connecting piece 4 is therefore pressed against a conic area (not illustrated) on the rail. In this way, a reliable metal-metal connection may be implemented again.

Thus, the three described exemplary embodiments demonstrate a very cost-effective and reliable connection between a rail 2 and an injector 3. Flange element 5 may have a two-part design as described in the first exemplary embodiment or a one-piece design as described in the second and the third exemplary embodiments. In particular, the number of parts needed for mounting injector 3 on rail 2 may be significantly reduced.

What is claimed is:

1. A fuel injection device, comprising:

a rail including at least one outflow opening;

at least one injector;

a connecting piece connected directly to the injector and formed as one piece with an undercut, the undercut including a protuberance that extends laterally from a central portion of the connecting piece;

a flange element for fastening the injector on the rail via the connecting piece, wherein the flange element includes a central opening through which the connecting piece is guided, wherein a clearance is present between a bottom most surface of the rail and a surface of the protuberance nearest the bottom most surface of the rail; and a metal-metal sealing provided between the connecting piece and the rail, wherein:

the flange element engages with the undercut of the connecting piece, the connecting piece presses against the rail in a sealing manner according to the metal-metal sealing, no metal-metal sealing with the rail is formed other than the metal-metal sealing of the connecting piece and the rail, the flange element has a first and a second fastening opening for receiving a first and a second fastening element, and the rail includes corresponding first and second fastening openings for receiving the first and second fastening elements so that by fastening the flange element to the rail through the first and the second fastenings in the first and second openings of the flange element and the rail, an axial preload force acts on the connecting piece to press against the rail in the sealing manner.

2. The fuel injection device as recited in claim 1, wherein the metal-metal sealing is implemented between the connecting piece and the rail with the aid of a ball-cone geometry.

3. The fuel injection device as recited in claim 2, further comprising:

a spherical area formed on the connecting piece; and a conic area formed on the rail.

4. The fuel injection device as recited in claim 3, wherein a longitudinal axis of the connecting piece intersects the spherical area of the connecting piece.

5. The fuel injection device as recited in claim 3, wherein: the undercut is located outside of the flange element.

6. The fuel injection device as recited in claim 3, wherein no portion of the fuel injector is in direct contact with the undercut.

7. The fuel injection device as recited in claim 3, wherein an exterior surface of a portion of the fuel injector that is closest to the rail is exposed to an external environment.

8. The fuel injection device as recited in claim 1, wherein the flange element has a two-part design including a first flange part and a second flange part.

9. The fuel injection device as recited in claim 8, wherein the first flange part is constructed in the same manner as the second flange part.

10. The fuel injection device as recited in claim 9, wherein the two-part flange element is divided at the central opening to enable a lateral mounting on the connecting piece.

11. The fuel injection device as recited in claim 10, wherein a first part of the two-part flange element, when mounted on the connecting piece, only surrounds a portion of a circumference of a body of the connecting piece, and wherein a second part of the two-part flange element, when mounted on the connecting piece, surrounds a remainder of the circumference of the connecting piece.

12. The fuel injection device as recited in claim 1, wherein the flange element has a one-piece design.

13. The fuel injection device as recited in claim 12, wherein the flange element includes a mounting opening connected to the central opening via a continuous connecting slot.

14. The fuel injection device as recited in claim 13, wherein the mounting opening is situated at an angle of approximately 45° to the central opening.

15. The fuel injection device as recited in claim 1, further comprising:

a connection in the form of a bayonet joint between the flange element and the connecting piece.

16. The fuel injection device as recited in claim 1, further comprising:

a bayonet element including a first flattened side and a second flattened side, the bayonet element being situated on the connecting piece.

17. The fuel injection device as recited in claim 1, wherein a first contact area and a second contact area for the undercut of the connecting piece are formed on the flange element.

18. The fuel injection device as recited in claim 1, further comprising:

a chamfer on the flange element.

19. The fuel injection device as recited in claim 1, wherein the connecting piece is situated on the injector in such a way that an axis of the injector is aligned with a longitudinal axis of the connecting piece.

20. The fuel injection device as recited in claim 1, wherein the axial preload force is applied to the connecting piece via the first and second fastening elements, the flange element, and the undercut.

21. The fuel injection device as recited in claim 1, wherein from a cross-sectional perspective, a surface of the undercut facing away from the bottommost surface of the rail forms a corner with a vertical surface of the central portion of the connecting piece, and wherein the flange directly engages the corner.

22. A fuel injection device, comprising:

a rail including at least one outflow opening;

at least one injector;

a connecting piece connected directly to the injector and formed as one piece with an undercut, the undercut including a protuberance that extends laterally from a central portion of the connecting piece;

a flange element for fastening the injector on the rail via the connecting piece, wherein the flange element includes a central opening through which the connecting piece is guided, wherein a clearance is present between a bottom most surface of the rail and a surface of the protuberance nearest the bottom most surface of the rail; and a metal-metal sealing provided between the connecting piece and the rail, wherein:

the undercut includes two surfaces of the connecting piece that are at an angle to one another and that meet at a corner, the flange element engages with the corner of the undercut of the connecting piece, the connecting piece presses against the rail in a sealing manner according to the metal-metal sealing, no metal-metal sealing with the rail is formed other than the metal-metal sealing of the connecting piece and the rail, and the connecting piece is situated in an interior of a longitudinal opening of the injector.

23. The fuel injection device as recited in claim 22, further comprising:

a spherical area formed on the connecting piece; and a conic area formed on the rail, wherein the metal-metal sealing is implemented between the connecting piece and the rail with the aid of a ball-cone geometry, and wherein a longitudinal axis of the connecting piece intersects the spherical area of the connecting piece.

24. The fuel injection device as recited in claim 22, wherein:

the undercut is located outside of the flange element.

25. The fuel injection device as recited in claim 22, wherein no portion of the fuel injector is in direct contact with the undercut.

26. The fuel injection device as recited in claim 22, wherein an exterior surface of a portion of the fuel injector that is closest to the rail is exposed to an external environment.

27. The fuel injection device as recited in claim 22, wherein:

the flange element has a two-part design including a first flange part and a second flange part, the first flange part is constructed in the same manner as the second flange part, the two-part flange element is divided at the central opening to enable a lateral mounting on the connecting piece, a first part of the two-part flange element, when mounted on the connecting piece, only surrounds a portion of a circumference of a body of the connecting piece, and a second part of the two-part flange element, when mounted on the connecting piece, surrounds a remainder of the circumference of the connecting piece.

28. The fuel injection device as recited in claim 22, wherein from a cross-sectional perspective, a surface of the undercut facing away from the bottommost surface of the rail forms a corner with a vertical surface of the central portion of the connecting piece, and wherein the flange directly engages the corner.

29. A fuel injection device, comprising:

a rail including at least one outflow opening;

at least one injector situated on the rail;

a connecting piece situated on the injector; and a flange element for fastening the injector on the rail, wherein:

the flange element includes a central opening through which the connecting piece is guided, a metal-metal sealing is provided between the connecting piece and the rail, the connecting piece is formed as one piece with an undercut, the undercut including a protuberance that extends laterally from a central portion of the connecting piece, the flange element engages with the undercut of the connecting piece, wherein a clearance is present between a bottom most surface of the rail and a surface of the protuberance nearest the bottom most surface of the rail, the connecting piece presses against the rail in a sealing manner, the connecting piece is situated on the injector in such a way that an axis of the injector is aligned with a longitudinal axis of the connecting piece and the flange element includes a central opening into which the connecting piece is inserted without a thread, while fastening elements engage in fastening openings of the flange element by a thread.

30. The fuel injection device as recited in claim 29, wherein from a cross-sectional perspective, a surface of the undercut facing away from the bottommost surface of the rail forms a corner with a vertical surface of the central portion of the connecting piece, and wherein the flange directly engages the corner.

* * * * *